United States Patent [19]

Morrell

[11] 4,072,876

[45] Feb. 7, 1978

[54] CORRUGATED SHADOW MASK ASSEMBLY FOR A CATHODE RAY TUBE

[75] Inventor: Albert Maxwell Morrell, Lancaster, Pa.

[73] Assignee: RCA Corporation, New York, N.Y.

[21] Appl. No.: 729,349

[22] Filed: Oct. 4, 1976

[51] Int. Cl.[2] ..... H01J 29/07; H01J 29/02

[52] U.S. Cl. ..... 313/403; 313/404

[58] Field of Search ..... 313/402, 403, 404, 407, 313/408

[56] References Cited

U.S. PATENT DOCUMENTS

| | | | |
|---|---|---|---|
| 2,728,008 | 12/1955 | Burnside | 313/402 |
| 2,951,179 | 8/1960 | Evans | 313/402 X |
| 2,961,560 | 11/1960 | Fyler | 313/408 X |
| 3,038,096 | 6/1962 | Knochel et al. | 313/402 |
| 3,109,117 | 10/1963 | Kaplan | 313/408 |
| 3,923,566 | 12/1975 | Law | 313/403 |
| 3,944,867 | 3/1976 | Kaplan | 313/403 |

*Primary Examiner*—Robert Segal

*Attorney, Agent, or Firm*—Glenn H. Bruestle; Dennis H. Irlbeck

[57] ABSTRACT

A shadow mask type of cathode ray tube is improved by corrugation of the mask and support of the corrugated mask at points of inflection at the edges of the mask.

28 Claims, 18 Drawing Figures

CORRUGATED SHADOW MASK ASSEMBLY FOR A CATHODE RAY TUBE

BACKGROUND OF THE INVENTION

This invention relates to shadow mask type cathode ray tubes and, particularly to means for supporting a shadow mask within such tubes.

In a shadow mask tube, a plurality of convergent electron beams are projected through a multi-apertured color selection shadow mask to a mosaic screen. The beam paths are such that each beam impinges upon and excites only one kind of color-emitting phosphor on the screen. Generally, the shadow mask is attached to a rigid frame, which in turn, is suspended within the picture tube envelope.

Presently, all commercial color picture tubes have a front or viewing faceplate portion that is either spherical or cylindrical. However, it is desirable to develop a tube having a generally flat faceplate. There are problems that must be solved before a tube having a flat faceplate is commercially feasible. A major problem involves the shadow mask. According to prior art tube design concepts, in tubes having curved faceplates, the shadow mask is similarly curved so that it somewhat parallels the faceplate contour. Thus, in keeping with these prior art concepts, in a tube with a flat faceplate, the corresponding shadow mask should also have an almost flat contour. However, such a mask has insufficient selfsupporting strength or rigidity. One way to provide this strength or rigidity would be to put the mask under tension as is done in some commercially available tubes having cylindrical faceplates. However, tension methods require undesirable and expensive frame structures. Another way of providing strength to the mask would be give it some degree of contour. But in addition to violating established design concepts, this method raises an additional doming problem. The problem of doming occurs during an initial period of tube operation. It is caused by shadow mask heating and expansion when the mask is bombarded by the electron beams.

SUMMARY OF THE INVENTION

A shadow mask type of cathode ray tube is improved by including a corrugated mask which is supported at points of inflection at the edges of the mask.

Since the mask is supported at points of inflection, expansion or doming is limited to occur between the support points and is therefore rendered negligible. At the same time, by departing from the constraints of prior art design concepts and providing a corrugated mask which doesn't parallel the faceplate contour, the desired mask rigidity is obtained.

DESCRIPTION OF THE PREFERRED EMBODIMENTS

Figure 1:
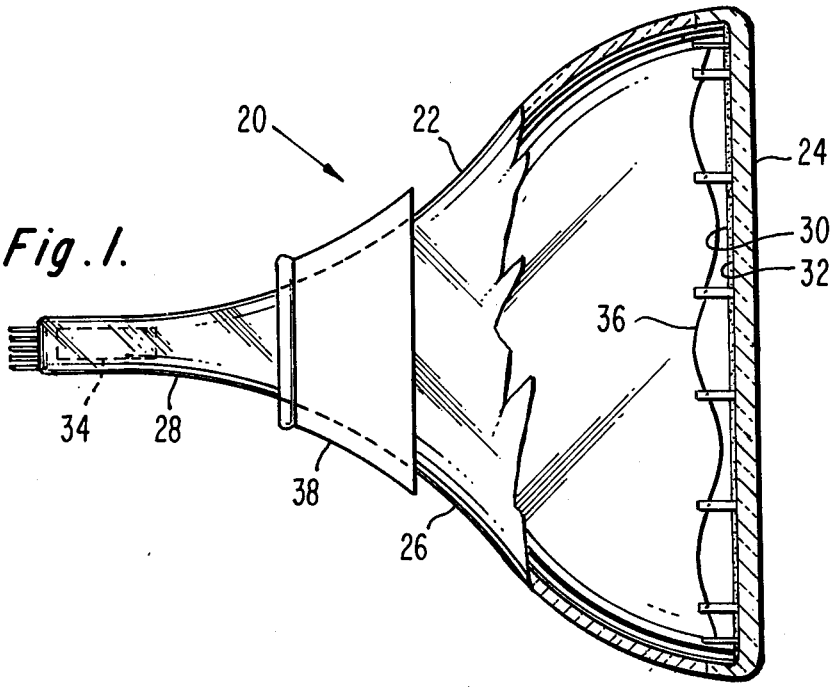
FIG. 1 is a partially cut-away top view of a cathode ray tube incorporating an embodiment of the present invention.

FIG. 1 illustrates an apertured-mask color television picture tube 20 constructed in accordance with the present invention comprising an evacuated glass envelope 22. The envelope 22 includes a rectangularly-shaped flat faceplate panel 24, a funnel 26, and a neck 28. A three-color phosphor-viewing screen 30 is supported on the inner surface 32 of the faceplate panel 24. An electron-gun assembly 34, positioned in the neck 28, includes three electron guns (not shown), one for each of the three color phosphors on the viewing-screen 30. A rectangular apertured mask 36 is positioned in the envelope 22 adjacent the viewing screen 30. The electron-gun assembly 34 is adapted to project three electron beams through the apertured mask 36 to strike the viewing-screen structure 30 with the mask 36 serving as a color selection electrode. A magnetic deflection yoke 38 is positioned on the envelope 22 near the intersection of the funnel 26 and the neck 28. When suitably energized, the yoke 38 causes the electron beams to scan the screen 30 in a rectangular raster.

Figure 2:
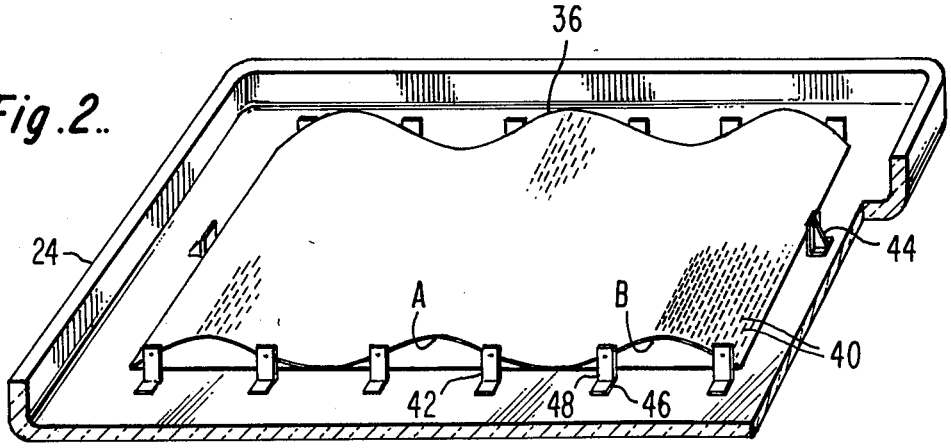
FIG. 2 is a perspective view of the mask-faceplate assembly of the tube of FIG. 1.

The apertured mask 36 further depicted in FIG. 2, is corrugated or somewhat sinusoidally curved along the horizontal axis (in the direction of the longer dimension of the mask) with the corrugations extending vertically (between long sides of the mask or in the direction of the shorter dimension of the mask). It should be understood that the term corrugated is herein defined broadly to include various shapes including a sawtooth waveform as well as sinusoidal shapes. Although the mask 36 is shown without any curvature vertically, it should be understood that a mask having some curvature along the vertical axis also is included within the scope of the present invention, an example of which will be presented later.

The mask 36 includes a plurality of slit-shaped apertures 40 aligned in vertical columns. In order to keep acceptable line formation on the screen, that is maintaining even spacing or nesting between the phosphor lines, the horizontal spacing between aperture columns is varied as a function of the spacing between the mask 36 and the screen 30 according to the following formula.

$$a = \frac{3sq}{L}$$

where:

$a$ — the horizontal spacing between aperture columns.

$q$ — the spacing between the mask and the faceplate.

L — the distance from the screen to the electron beam deflection plane.

$s$ — the spacing between a center and outer beam at the deflection plane.

Therefore, once the mask contour "$g$" is established to obtain desired strength and/or rigidity, the parameter "$a$" is allowed to vary horizontally over the mask in accordance with such mask contour. Generally, the peak-to-peak wavelength dimension (e.g. from point A to point B) of the corrugated or sinusoidal variation in the mask should be at least twice as great as the spacing between adjacent apertures.

As shown in FIG. 2, the apertured mask 36 is mounted to the faceplate panel 24 by a plurality of flexible supports 42 positioned along corrugated sides of the mask 36 and rigid supports 44 positioned at the straight sides of the mask 36. Each of the flexible supports 42 is L-shaped, comprising two flanges 46 and 48, and is attached to the faceplate panel 24 at the bottom flange 46 by suitable means such as by being sealed with a glass frit. The second flange 48 of each flexible support 42 is cantilevered out from the faceplate panel 24 and provides the flexible portion of the support 42. The mask 36 is connected to the flexible supports 42 on the corrugated sides at points of inflection where the direction of curvature of the mask changes. Such points are on the centerline of the corrugated or sine-wave mask shape. The cantilever structure of the supports 42 permits flexibility in the direction of the corrugations, i.e. in the vertical direction (as determined by the tube in its normal operating orientation) thus allowing for thermal expansion of the mask in this direction. Since the phosphor lines extend vertically, there is no misregister caused by mask expansion in the vertical direction. In the perpendicular or horizontal direction, however, the supports 42 are very rigid. Correspondingly, the supports 44 on the side of the mask 36 are rigid in both the horizontal and vertical directions and hold the center of the mask from movement.

Figure 3:
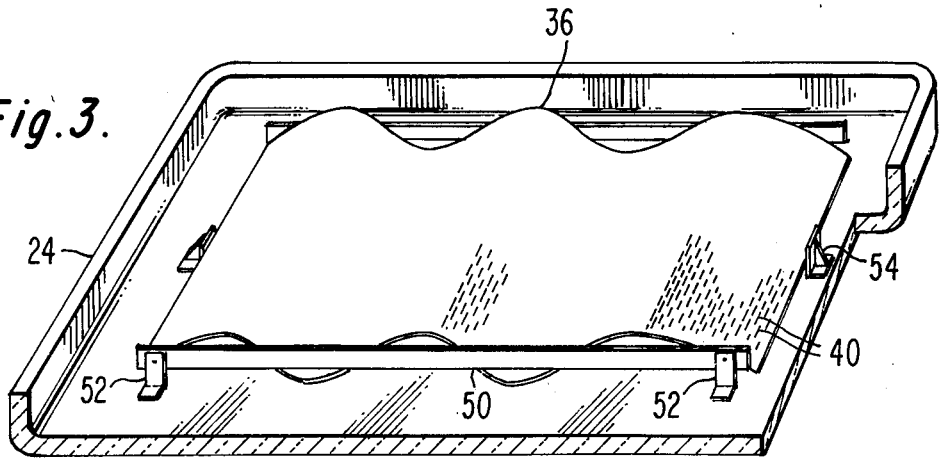
FIG. 3 is a perspective view of a modification of the mask-faceplate assembly of FIG. 2.

An alternative version of a mask supporting embodiment that provides a similar type of mask suspension is shown in FIG. 3. In this embodiment, the flexible supports at the top and bottom of the mask are replaced with two metal bars 50 having low expansion characteristics relative to the mask material. For example, if the material of the mask 36 is steel, the bars 50 may be invar. The mask is connected to the support bars 50 along the centerline of its corrugated or sine-wave shaped sides. The bars 50 in turn are mounted to the faceplate panel 24 by flexible supports 52 that are attached near each end of each bar 50. Side supports 54 for the mask 36 are attached to the short sides of the mask and perform the same function as described with respect to the supports 44 of the previous embodiment, that of fixing the position of the center of the mask.

Figure 4:
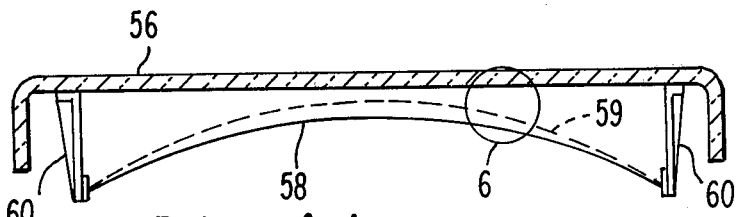
Prior Art Fig. 4.
FIG. 4 is a top view of a mask-faceplate assembly suggested by prior art.
Figure 5:
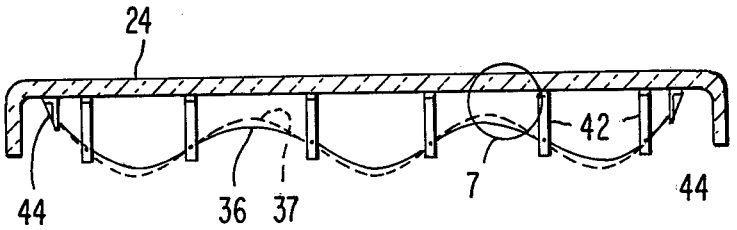
FIG. 5 is an enlarged top view of the mask-faceplate assembly of the tube of FIG. 1.

An advantage of the mask support of the present invention can be appreciated by comparing an embodiment of the invention with an embodiment suggested by the prior art. FIG. 4 shows a flat faceplate 56 having a spherically contoured apertured mask 58 mounted thereto by means of rigid support members 60. FIG. 5 shows a similar view of the faceplate and mask assembly of the tube of FIG. 1. The dashed lines 59 and 37 in FIGS. 4 and 5, respectively, represent the configuration the masks take in a condition of thermal expansion due to bombardment by the electron beams. The spherical mask 58 of FIG. 4, being held at its edges by the supports 60, domes substantially toward the faceplate 56. However, the mask 36 of FIG. 5 is held at various points by the supports 42 and therefore only domes between these support points.

Figure 6:
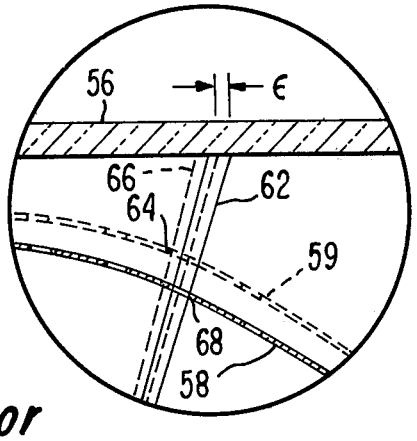
Prior Art Fig. 6.
FIGS. 6 and 7 are enlargements of the portions designated 6 and 7 in FIGS. 4 and 5, respectively.
Figure 7:
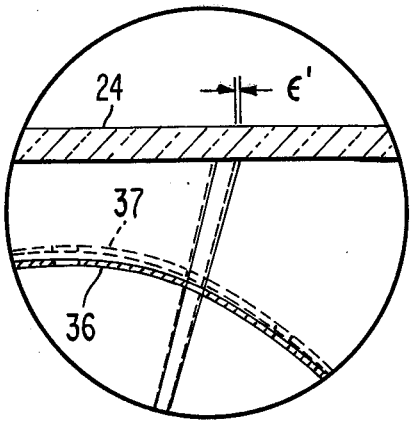

The net effect of this doming is illustrated in FIGS. 6 and 7, which are enlargements of the indicated areas of FIGS. 4 and 5, respectively. As shown in FIG. 6, the landing spot of an electron beam 66 passing through an aperture 64 of the heated domed mask 59 is displaced a distance from the landing spot of an electron beam 62 passing through an aperture 68 of an unheated mask 58. However, in a tube using the present invention, displacement of the heated mask is much less. FIG. 7 shows the position of the heated mask 37 only slightly moved from the position of the unheated mask 36. The resultant shift of the beam spot is designated $\epsilon'$, which from the illustrations can be seen to be considerably less than the shift encountered with the prior art tube because of the reduced mask movement.

Figure 9:
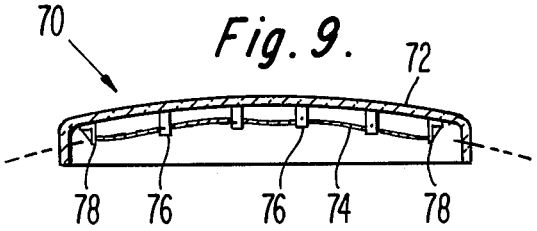
FIGS. 8, 9 and 10 are back, top and side views, respectively, of a cathode-ray tube cylindrical mask-faceplate assembly.
Figure 8:
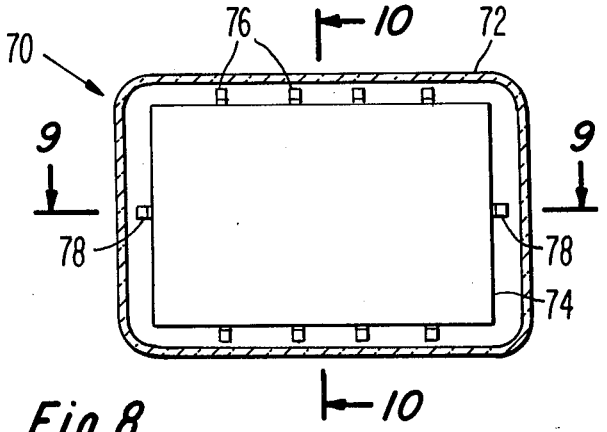
Figure 10:
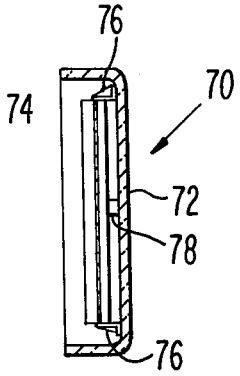

Although the invention has been described with respect to a flat faceplate, it should be appreciated that the invention is also applicable if the faceplate has curvature. FIGS. 8, 9 and 10 depict a faceplate panel assembly 70 having a rectangular faceplate 72 that is cylindrically curved and to which an apertured mask 74 is mounted by means of flexible and rigid supports, 76 and 78, respectively. The mask 74 is corrugated with the points of inflection of the corrugations lying in a curved or cylindrical plane. The flexible supports 76 extend from the faceplate 72 and are attached to the long sides of the mask 74 at the points of inflection. The rigid supports 78 also extend from the faceplate 72 and are attached to the mask 74 at the center of its short sides.

Figure 12:
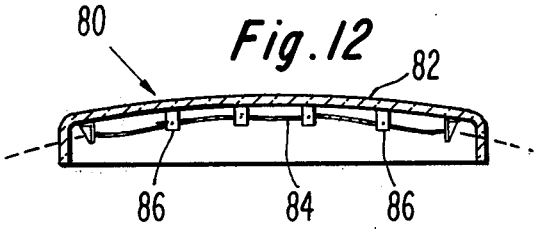
FIGS. 11, 12 and 13 are back, top and side views, respectively, of a cathode-ray tube spherical mask-faceplate assembly.
Figure 11:
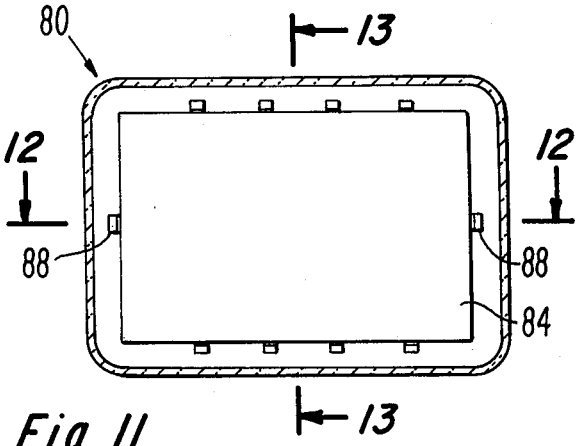
Figure 13:
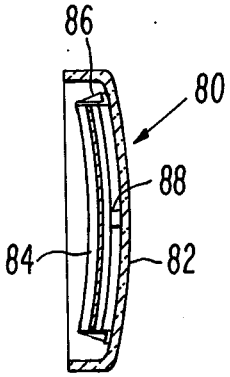

In another embodiment, illustrated in FIGS. 11, 12 and 13, a faceplate panel assembly 80 is shown with a spherically curved faceplate 82. A mask 84 is attached to the faceplate 82 by means of flexible and rigid supports 86 and 88, respectively. The mask 84 is spherically curved similar to the faceplate 82 and has vertically extending corrugations superimposed thereon. Like the previous embodiment, the flexible supports 86 extend from the faceplate 82 and are attached to the points of inflection along the long sides of the mask 84 and the rigid supports 88 are attached to the centers of the short sides of the mask.

Figure 14:
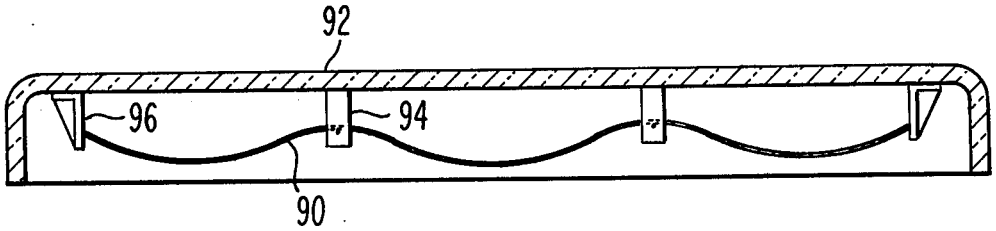
FIG. 14 is a top view of a mask-faceplate assembly of a cathode-ray tube incorporating another embodiment of the present invention.
Figure 15:
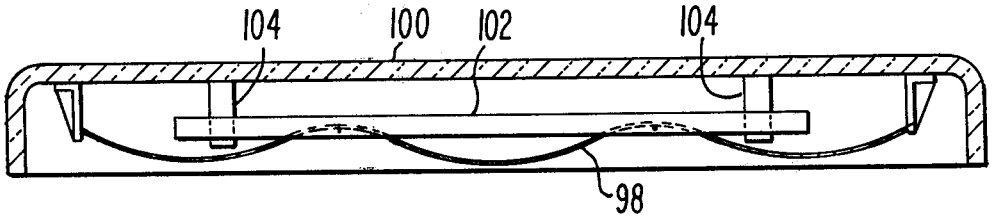
FIG. 15 is a top view of a mask-faceplate assembly of a cathode-ray tube incorporating yet another embodiment of the present invention.

Although the preceding embodiments have been shown with the corrugated masks attached to the supports at the points of inflection at the corrugated sides of the masks, the scope of the invention can include other mounting points. For example, the mounting points may be at any other regular points on the mask that are a fixed distance from a reference plane such as at the points on the mask nearest the faceplate panel. FIGS. 14 and 15 show such a mask support system. In FIG. 14, a corrugated mask 90 is shown mounted to a flat faceplate panel 92 by means of flexible and rigid supports 94 and 96, respectively. The flexible supports 94 are affixed to the panel 92 and are attached to the corrugated sides of the mask at points on the mask closest to the faceplate panel.

Correspondingly, FIG. 15 shows a corrugated mask 98 mounted at its corrugated sides to a faceplate panel 100 with metal bars 102 which are attached to and at least partially supported by flexible supports 104 similar to those shown with respect to the embodiment of FIG. 3. It should be appreciated, however, that the effect of doming in the embodiments of FIGS. 14 and 15, although much less than the single arch embodiment of FIG. 4, will be somewhat greater than the embodiment of FIG. 5 wherein the mask is supported at points of inflection since the mask span between supports is greater.

In all of the foregoing embodiments the mask supports have been shown extending directly from the edges of the viewing portion of the tube faceplate as illustrative examples. This is only one possible arrangement of the supports within the scope of the present invention. The supports also can be extended from the sidewalls of the tube faceplate instead of from the viewing portion. Alternately, the supports can also extend between the mask and a frame which in turn is suspended within the tube faceplate.

Figure 16:
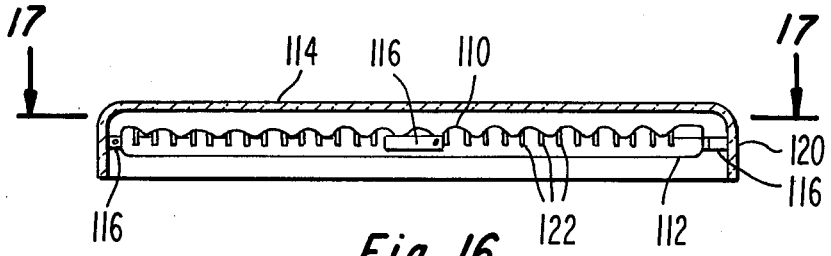
FIG. 16 is a top view of a mask-faceplate assembly of a cathode-ray tube incorporating still another embodiment of the present invention.
Figure 17:
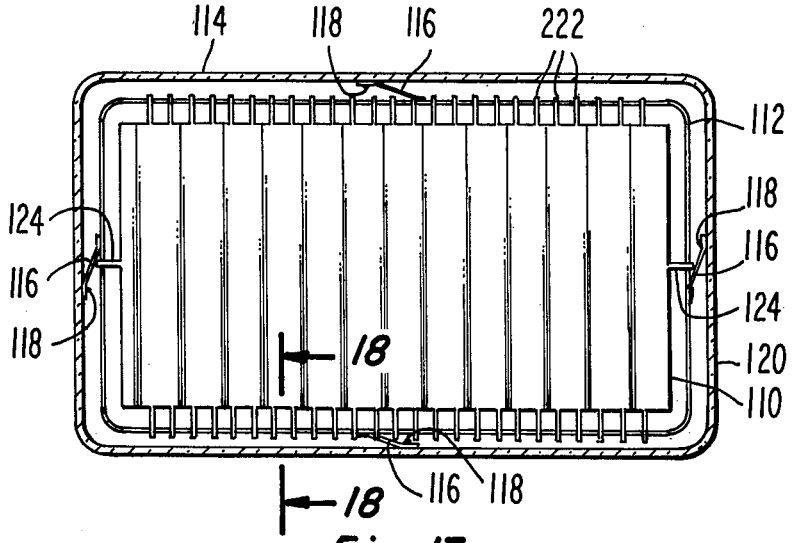
FIG. 17 is a section view taken at lines 17—17 in FIG. 16.
Figure 18:
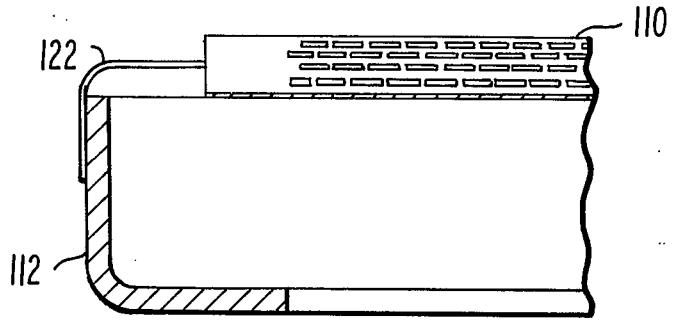
FIG. 18 is a enlarged partial section view taken at lines 18—18 in FIG. 17.

FIGS. 16, 17 and 18 illustrate another embodiment incorporating the present invention wherein a corrugated rectangular apertured mask 110 is attached to a peripheral frame 112. The frame 112 is suspended within a flat rectangular faceplate panel 114 by a plurality of spring supports 116 that are removably mounted on conical studs 118 embedded within a peripheral sidewall 120 of the panel 114. The attachment of the mask 110 to the frame 112 is made by means of a plurality of tabs 122 formed integrally as part of the mask structure. Each tab 122 extends from a side of the mask 110 at a point of inflection on the corrugated cross-section and is welded to a flange of the frame 112. Two additional tabs 124 are located at the center of the two opposite vertical sides of the mask to prevent vertical displacement of the mask during tube operation.

The tabs 122 and 124 are preferably formed by adding their outline to the photographic masters that are used to expose the aperture pattern during mask fabrication. The final shape of the mask and tabs are then defined when the mask is etched.

I claim:

1. In a shadow mask type cathode-ray tube, the improvement comprising, a shadow mask corrugated in one direction having two corrugated sides and two other sides and at least partially suspended in said tube by support means attached at a plurality of points along the corrugated sides of said mask, said mask including a plurality of slit-shaped apertures aligned in columns and the peak-to-peak wavelength dimension of corrugations in the mask being at least twice as great as the spacing between aperture columns.

2. The tube as defined in claim 1, wherein said plurality of points are substantially equidistant from an inner surface of a faceplate panel of said tube.

3. The tube as defined in claim 2, wherein said faceplate panel is substantially flat.

4. The tube as defined in claim 2, wherein said faceplate panel is curved.

5. The tube as defined in claim 4, wherein said faceplate panel is cylindrical.

6. The tube as defined in claim 4, wherein said other sides are curved relative to said panel.

7. The tube as defined in claim 1, wherein said plurality of points are points of inflection at the corrugated shaped sides of the mask.

8. The tube as defined in claim 7, wherein said points of inflection lie in a flat plane.

9. The tube as defined in claim 7, wherein said points of inflection define a curved configuration.

10. The tube as defined in claim 9, wherein said curved configuration is cylindrical.

11. The tube as defined in claim 9, wherein said other sides are curved relative to said panel.

12. The tube as defined in claim 1, wherein said mask is rectangular and has two short sides and two long sides, the corrugations extending from one long side to the other long side, said long sides being said corrugated sides and said support means being attached to the long sides of said mask.

13. The tube as defined in claim 12, including restraints attached to the centers of the short sides of the mask.

14. The tube as defined in claim 1, wherein said support means includes flexible portions to allow for expansion of said mask.

15. The tube as defined in claim 14, wherein said support means includes individual supports attached to each point of inflection at the edges of said mask, said individual supports each being separately affixed to a faceplate panel of said tube.

16. The tube as defined in claim 14, wherein said support means includes bar members attached to each point of inflection at the edges on opposite sides of said mask, said bar members being supported by said flexible portions, said bar members being of a material having a substantially lower thermal expansion coefficient than said mask.

17. The tube as defined in claim 14, wherein said support means includes individual supports attached to points at the edges of said mask closest to a faceplate panel of said tube.

18. The tube as defined in claim 14, wherein said support means includes bar members attached to points at edges on opposite sides of said mask near a faceplate panel of said tube, said bar members being of a material having a substantially lower thermal expansion coefficient than said mask.

19. The tube as defined in claim 1, including the spacing between centerlines of adjacent apertures in the one direction in said mask varying in relation to the variation in spacing between a screen of said tube and the mask.

20. In a shadow mask type cathode ray tube including a line screen on an inner surface of a faceplate and a shadow mask having elongated apertures mounted within said tube on supports in spaced relation to said screen, the improvement comprising, said shadow mask being corrugated and having a substantially sinusoidal cross-section in one direction, said supports for holding said mask being attached at the corrugated edges of said mask that extend in the one direction at points of inflection in the mask, and the spacing between centerlines of adjacent apertures in the one direction in said mask varying as a function of the variation in spacing between the screen and the mask.

21. The tube as defined in claim 20, wherein the peak-to-peak wavelength dimension of the cross-section of the mask in one direction is at least twice as large as the largest spacing between centerlines of adjacent apertures in one direction.

22. In a shadow mask type cathode ray tube including a cathodoluminescent screen on an inner surface of a rectangular faceplate and a rectangular shadow mask mounted within said tube in spaced relation to said screen, the improvement comprising, said shadow mask being corrugated having two corrugated-shaped sides and two other sides, and flexible supports interconnecting said mask to said faceplate, said supports being attached to the corrugated sides of said mask at points of inflection of the corrugations, said supports being flexible in a direction parallel to said other sides of the mask to allow expansion of said mask in a direction parallel to sides of the mask, said flexible supports being rigid in a direction parallel to the corrugated sides of the mask.

23. The tube as defined in claim 22 including rigid supports on said other sides of said mask.

24. The tube as defined in claim 23 including said rigid supports being attached to the mask only at the midpoint of the said other sides of the mask.

25. The tube as defined in claim 24 including the spacing between centerlines of adjacent apertures in a direction parallel to the corrugated sides of said mask varying in relation to the variation in spacing between the screen and the mask.

26. The tube as defined in claim 22 wherein said flexible supports are tabs formed integrally with said mask.

27. In a shadow mask type cathode ray tube including a line screen on an inner surface of a faceplate and a shadow mask having elongated apertures mounted within said tube on supports in spaced relation to said screen, the improvement comprising, said shadow mask being corrugated and having a substantially sinusoidal cross-section in one direction, and said supports for holding said mask being attached at the corrugated edges of said mask that extend in the one direction at points of similar amplitude of the corrugations relative to the inner surface of the faceplate.

28. In a shadow mask type cathode ray tube including a cathodoluminescent screen on an inner surface of a faceplate and a shadow mask mounted within said tube in spaced relation to said screen, the improvement comprising, said shadow mask being corrugated having two corrugated-shaped sides and two other sides, and flexible supports interconnecting said mask to said tube, said supports being attached to the corrugated sides of said mask at points of similar amplitude of the corrugations relative to the inner surface of the faceplate, said supports being flexible in a direction parallel to said other sides of the mask to allow expansion of said mask in a direction parallel to sides of the mask, said flexible supports being rigid in a direction parallel to the corrugated sides of the mask.

* * * * *